United States Patent [19]

Peng

[11] Patent Number: 4,656,482

[45] Date of Patent: Apr. 7, 1987

[54] WIDEBAND WING-CONFORMAL PHASED-ARRAY ANTENNA HAVING DIELECTRIC-LOADED LOG-PERIODIC ELECTRICALLY-SMALL, FOLDED MONOPOLE ELEMENTS

[75] Inventor: Sheng Y. Peng, Escondido, Calif.

[73] Assignee: Teledyne Micronetics, San Diego, Calif.

[21] Appl. No.: 786,980

[22] Filed: Oct. 11, 1985

[51] Int. Cl.[4] ..... H01Q 1/28; H01Q 11/10

[52] U.S. Cl. ..... 343/705; 343/792.5

[58] Field of Search ..... 343/705, 709, 792.5, 343/829, 846

[56] References Cited

U.S. PATENT DOCUMENTS 4,296,416 10/1981 Harader ..... 343/792.5

*Primary Examiner*—Eli Lieberman

*Attorney, Agent, or Firm*—Charmasson & Holz

[57] ABSTRACT

A compact, lightweight, wideband, wing-conformal phased-array antenna structure, the array elements of which are identical, log-periodic arrangements of electrically small, folded-monopole elements printed on both sides of a dielectric substrate. A significant reduction in the height of the array elements makes this array configuration feasible for many airborne applications.

10 Claims, 4 Drawing Figures

FIG. 1
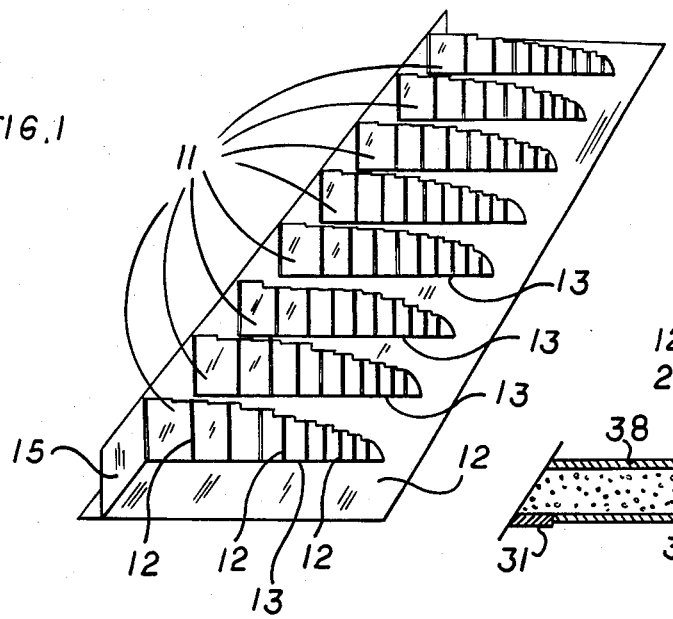
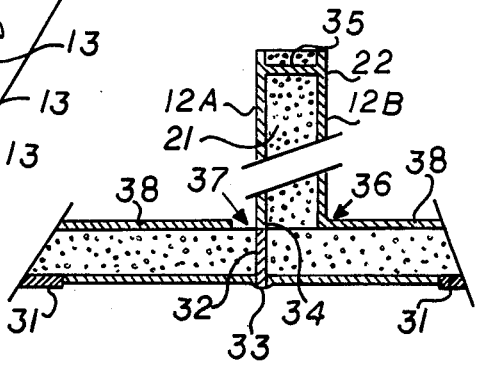
FIG. 3
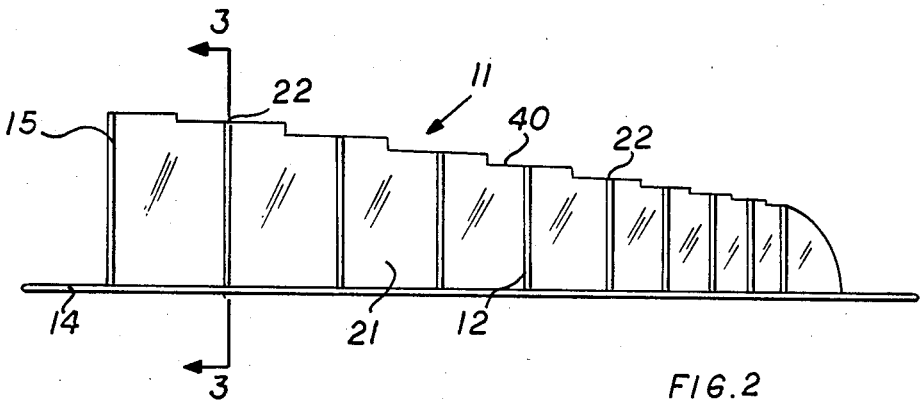
FIG. 2
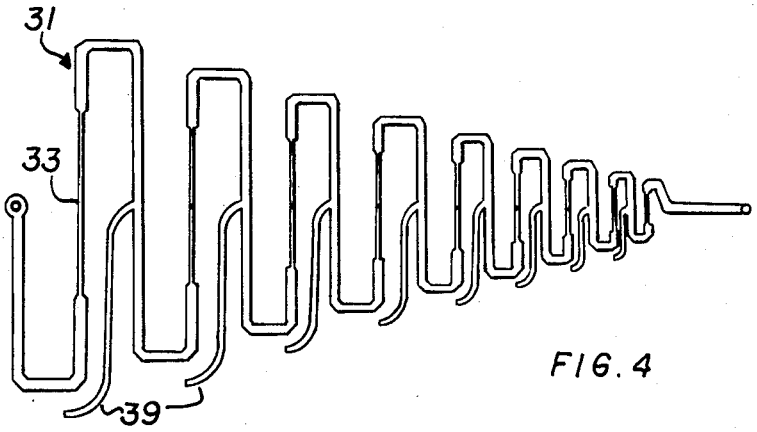
FIG. 4

WIDEBAND WING-CONFORMAL PHASED-ARRAY ANTENNA HAVING DIELECTRIC-LOADED LOG-PERIODIC ELECTRICALLY-SMALL, FOLDED MONOPOLE ELEMENTS

FIELD OF THE INVENTION

The present invention relates to microwave antennas of the phased-array type, and, more specifically, to those having array elements comprised of log-periodic arrangements of monopole elements.

BACKGROUND OF THE INVENTION

Phased-array antennas have been widely used as scanning antennas because they can be used to scan a wide area without changing the orientation of the antenna array. This is accomplished by incorporating a phase shifter in the feed line of each phased-array element. The resultant wave-front vector of the phased-array antenna is equal to the sum of the array element wave-front vectors. In order to produce a phased-array antenna with wideband frequency sensitivity, log-periodic arrangements of monopole elements have been successfully used as phased-array elements.

If properly designed, an antenna comprising a log-periodic arrangement of monopole elements is frequency independent over a given frequency band. Like other antennas of log-periodic design, the variation of performance is periodic with respect to the logarithm of frequency. Thus, the antenna is frequency independent to the degree that its performance variation with frequency is minimal over a log period. The frequency independence of the log-periodic design can be attributed to the geometrical progression of the monopole elements and their spacings. The heights, h, and the spacings, d, of consecutive monopole elements are related by a scaling factor, $\tau$.

$$\tau = h_{n-1}/h_n = d_{n-1}/d_n$$

A second design parameter, the spacing factor, $\sigma$, relates height to spacing for a cell within the log-periodic array.

$$\sigma = d_n/4h_n$$

Theoretically, a log-periodic monopole antenna can operate over an infinite bandwidth. However, practical considerations require that such an infinitely long structure be truncated at both the high and low frequency ends, effectively establishing minimum and maximum operating frequencies. While operating at a frequency between the minimum and maximum operating frequencies, a log-periodic array can be divided into three functional regions: a transmission region, an active region, and an unexcited region. The transmission region consists of the monopole elements which are significantly less than a quarter wavelength in height; the unexcited region consists of the non-resonant monopole elements which are significantly greater than a quarter wavelength in height. The active region consists of the radiating monopole elements which are essentially a quarter wavelength in height. As the frequency is varied, the active region simply shifts to that portion of the array where the elements are approximately one-quarter wavelength in height.

In order to produce a directional wavefront, and to minimize excitation of higher-order resonances in the unexcited region of the array, the array is typically fed from the high-frequency end with a feedline element-to-element phase progression equal to or slightly less than a 180-degree, free-space phase shift.

A major objective of classical antenna design has been to reduce the physical size of the antenna without adversely affecting its sensitivity. For certain applications, the height of a phased-array antenna comprised of log-periodic monopole array elements is excessive. What is needed is an antenna design which incorporates all the advantages of this type of antenna, yet which is more compact.

SUMMARY OF THE INVENTION

The object of the present invention is to halve the height of the contemporary wideband, log-periodic, monopole, phased-array antenna. This is accomplished by utilizing monopole elements which are folded over a dielectric substrate. For the preferred embodiment of the invention, all the folded monopole elements for each array element are printed or deposited on both sides of the dielectric substrate. Using the folded monopole technique, it is possible to design a phased array using log-periodic array elements which is about one-eighth wavelength in height.

BRIEF DESCRIPTION OF THE DRAWINGS

FIG. 1 is a perspective view of the antenna array;

FIG. 2 is a side elevational view of an array element;

FIG. 3 is a cross-sectional view, taken along line 3—3 of FIG. 2; and

FIG. 4 is partial bottom plan view of the ground plane of the array, showing one possible feed structure.

DESCRIPTION OF THE PREFERRED EMBODIMENTS OF THE INVENTION

Although the present invention is described in connection with a multi-element phased-array antenna structure for aircraft wing applications, it is to be understood that the invention is not limited thereto. A phased-array antenna having eight identical array elements 11 is shown in FIG. 1. Each array element 11 comprises a log-periodic arrangement of nine electrically-small, folded-monopole elements 12. The lower edge 13 of each array element 11 is soldered to the upper face of a first rectangular sheet 14 of fiberglass-reinforced plastic having a thickness of 0.257 cm. First sheet 14 provides structural integrity to the array structure and also serves as a feedline substrate. The rear edge of each monopole array element 11 is bonded to one face of a second rectangular sheet 15 of fiberglass-reinforced plastic. Second sheet 15 provides vertical stability to the array structure. In addition, foam, honeycomb, or spacers comprised of other material may be used between adjacent monopole array elements to reinforce the array structure.

Referring now to FIG. 2, each array element 11 comprises a sheet of fiberglass-reinforced plastic substrate 21 having a maximum height of 6.1 cm, a length of 25.4 cm, a thickness of 0.257 mm, and a dielectric constant, $\epsilon_Y$, of 2.3. These dimensions, of course, are with reference to a specific design configuration which embodies the instant claims. For other frequency requirements, the array element dimensions will differ according to the substrate dielectric constant and thickness.

All nine monopole elements 12 are printed simultaneously on both sides of the array element substrate 21 utilizing the photoetching technique that is typically used for the production of printed circuit boards. The height of the array elements depends on the operational frequency bandwidth requirement. The described invention operates at about 3:1 bandwidth with the lowest frequency about 35 percent below L-band, 1 GHz. With height reduced, an array can be placed in much smaller locations than previously possible. The physical geometry of the instant array is particularly shaped to fit into an aircraft's wing, thus forming a so-called "wing-conformal phased array". The achieved height reduction in log periodic elements also makes this array configuration feasible for many airborne applications.

The folded monopole can be formed either by having the metallic strip which comprises a monopole element wrap over the top edge of the array element substrate, or by connecting the two strips on opposite sides of the substrate by means of a feed-through perforation 22 near the top of the array element. The latter method is preferred and is shown in the drawing.

The complete structure of a monopole element 12 is shown in FIG. 3. Monopole element 12 consists of a first conductive strip 12A and a second conductive strip 12B, which are located on opposite faces of substrate 21. Conductive strip 12A is in the shape of a monopole, while the second conductive strip 12B acts as a tuning element which could assume a "T" or other equivalent shape. Element 12 is fed from feedline 31, which is printed on the lower surface of first sheet 14. Conduction from feedline 31 is via the conductive material 32 which lines feed-through perforation 33 in first sheet 14. The base 34 of first conductive strip 12A is solder-connected to the conductive material 32 lining feed-through perforation 33. The top of first conductive strip 12A is connected to the top of second conductive strip 12B by the conductive lining 35 of feed-through perforation 22. A short 36 is at the bottom of second conductive strip 12B and the bottom edge of substrate 21 where continuity is provided to a ground plane 38, which is printed on the upper surface of first sheet 14. A gap 37 between ground plane 38 and the bottom of first conductive strip 12A on the top surface of substrate 14 is provided so that feedline 31 is not shorted with the ground plane.

The feed line of each monopole array 11 is illustrated in FIG. 4. The conventional log-periodic dipole array feed technique which uses the transposition of wires to provide 180 degrees of phase shift between two consecutive elements cannot be used here. The device instead uses a meandering microstrip line 31 which relies on impedance modulation techniques to improve the match of the array over a broad frequency range and minimize structural stopband problems. The feed line essentially consists of a meandering 50 ohm microstrip transmission line 31 with quarter-wavelength stubs 39 located at a quarter-wavelength past the feed point 33 of each monopole element 12. The function of each stub is to prevent the energy from passing through each radiating element and to improve the feed line efficiency. The dielectric constant of the feed line substrate constituted by sheet 14 is similar to the dielectric constant of the monopoles substrate 21. Higher dielectric constants could be used to broaden the bandwidth.

According to the above-described configuration each quarter wavelength monopole 12 is folded over a portion of substrate 21 whose height varies with the half length of each monopole but need not exceed one eighth of the wavelength of the corresponding signal.

The upper edge 40 of each element substrate defines a slope which allows the array to conveniently fit into the wing or other compact area of a plane.

While the preferred embodiment of the invention has been described, modification can be made and other embodiments may be devised within the spirit of the invention and the scope of the appended claims.

What is claimed is:

1. A phase array antenna for the transmission and reception of multiple frequency electromagnetic signals which comprises:

a first planar sheet of dielectric substrate;

a plurality of monopole elements, each of said elements comprising:

a first conductive strip bonded to one face of said first sheet, a second conductive strip bonded to the other face of said first sheet opposite said first strip;

means for connecting a set of proximal ends of said first and second strips together across the thickness of said first sheet;

a second planar sheet of dielectric substrate supporting said first sheet orthogonally;

a feed line bonded to the surface of said second sheet; and means for connecting the free end of said first strip to said feed line.

2. The structure of claim 1 wherein the length of each of said first strip is equal to one-eighth wavelength of the signal corresponding to said monopole.

3. The strucuture of claim 2 wherein said monopole elements are arranged in a log-periodic array over the surface of said first sheet.

4. The structure of claim 3 wherein said second planar sheet supports a plurality of log-periodic array sheets.

5. The structure of claim 3 which further comprises a ground plane bonded to one of the surfaces of said second sheet opposite said feed-line, and means for connecting the free end of said second strip to said plane.

6. The structure of claim 3 wherein the edge of said first sheet opposite said second sheet define a slope corresponding to the connected ends of said first and second strips.

7. The structure of claim 6 shaped and dimensioned for installation into a plane wing.

8. The structure of claim 7 which further comprises a third sheet mounted orthogonally to said first and second sheets and abutting the higher end of said first sheets.

9. The structure of claim 3 wherein said feed line comprises a meandering microstrip transmission line having quarter wavelength stubs connected a quarter-wavelength past the point of contact between said transmission line and each of said first strip.

10. The structure of claim 9 wherein said second strip is shaped and dimensioned to act as a tuning element.

* * * * *